US008490755B2

(12) United States Patent
Lindberg

(10) Patent No.: US 8,490,755 B2
(45) Date of Patent: Jul. 23, 2013

(54) CIRCUIT FOR RESETTING AN ELEVATOR SAFETY CHAIN

(75) Inventor: Bjarne Lindberg, Adligenswil (CH)

(73) Assignee: Inventio AG, Hergiswil (CH)

( * ) Notice: Subject to any disclaimer, the term of this patent is extended or adjusted under 35 U.S.C. 154(b) by 378 days.

(21) Appl. No.: 12/735,219

(22) PCT Filed: Dec. 15, 2008

(86) PCT No.: PCT/EP2008/067532

§ 371 (c)(1),
(2), (4) Date: Jan. 24, 2011

(87) PCT Pub. No.: WO2009/080585

PCT Pub. Date: Jul. 2, 2009

(65) Prior Publication Data

US 2011/0155510 A1 Jun. 30, 2011

(30) Foreign Application Priority Data

Dec. 21, 2007 (EP) ..... 07124046

(51) Int. Cl.
*B66B 1/34* (2006.01)

(52) U.S. Cl.
USPC ..... 187/393; 187/314

(58) Field of Classification Search
USPC ..... 187/247, 248, 277, 300, 301–303, 187/313, 314, 316, 391–393
See application file for complete search history.

(56) References Cited

U.S. PATENT DOCUMENTS

| | | | | |
|---|---|---|---|---|
| 3,791,490 | A * | 2/1974 | Smith | 187/278 |
| 3,792,759 | A * | 2/1974 | Kirsch | 187/278 |
| 4,440,266 | A * | 4/1984 | Kohler | 187/247 |
| 5,787,020 | A * | 7/1998 | Molliere et al. | 702/183 |
| 6,223,861 | B1 * | 5/2001 | Sansevero | 187/316 |
| 6,330,936 | B1 * | 12/2001 | Lence Barreiro et al. | 187/393 |
| 6,550,585 | B2 * | 4/2003 | Schoppa et al. | 187/391 |
| 6,603,398 | B2 * | 8/2003 | Tinone et al. | 340/541 |
| 7,350,626 | B2 * | 4/2008 | Lence et al. | 187/393 |
| 7,708,118 | B2 * | 5/2010 | Tyni et al. | 187/391 |
| 8,069,958 | B2 * | 12/2011 | Lence-Barreiro | 187/393 |

FOREIGN PATENT DOCUMENTS

| | | |
|---|---|---|
| EP | 0 725 033 | 7/1996 |

* cited by examiner

*Primary Examiner* — Anthony Salata
(74) *Attorney, Agent, or Firm* — Wolff & Samson, PC

(57) ABSTRACT

A circuit (34) for resetting a component (21) within an elevator safety chain (23). The reset circuit (24) comprises a first reset switch (31), a second reset switch (32) and a door contact (33). This first reset switch is mountable within an elevator shaft (2) and the second reset switch (32) is mountable outside the elevator. Preferably, the second reset switch (32) is hidden from members of the general public but is accessible to an elevator technician. The door contact (33) is mountable alongside the landing door (13). The first reset switch (31), the second reset switch (32) and the door contact (33) are arranged in series so that all must be closed to reset the component (21) whereby, upon activation, the first reset switch (31) remains closed for a first predetermined time period ($\Delta t_1$) after which it returns to its open state.

10 Claims, 4 Drawing Sheets

FIG. 6
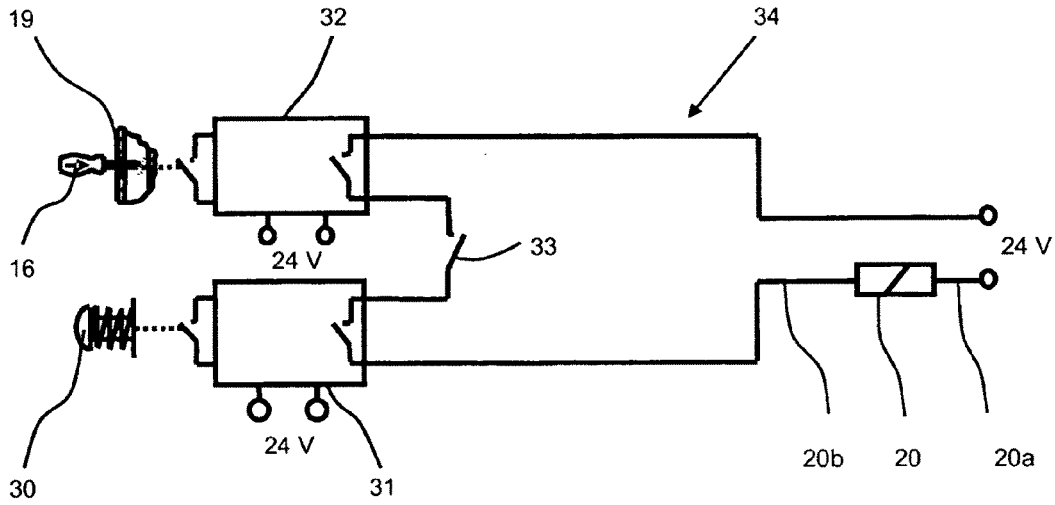
FIG. 7a
FIG. 7b
FIG. 7c
FIG. 7d
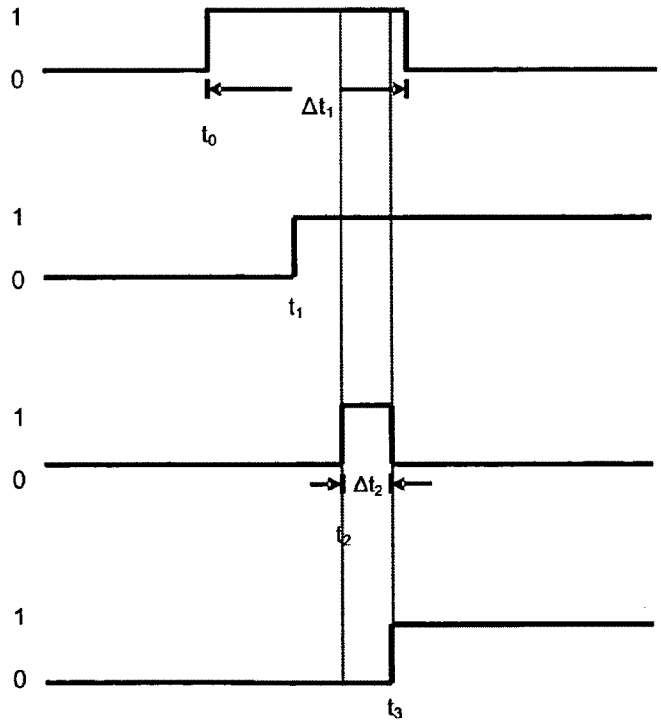

CIRCUIT FOR RESETTING AN ELEVATOR SAFETY CHAIN

The present invention relates to elevators and, in particular, to a circuit for resetting an elevator safety chain after service technicians have performed necessary maintenance or inspection operations within an associated elevator shaft.

It is common practice within the elevator field for service technicians to enter an elevator shaft to conduct periodic maintenance or inspection operations. The majority of the required operations can be conducted from either the shaft pit or alternatively throughout the shaft using the roof of an elevator car as a working platform. The frequency of this practice has increased significantly in recent years due primarily to the higher prevalence of machine-room-less installations within the industry whereby elevator components which where traditionally housed in a dedicated, separate machine room are now fully incorporated within the elevator shaft.

Before any such work can be carried out within the shaft, local regulations such as the ASME A17.1-2000 safety code for the United Stated of America or the EN 81-1:1998 standard throughout Europe stipulate that refuge or safety spaces must be created to protect any service technicians working in the pit or working from the roof of the car. Obviously, the required refuge spaces can be permanently incorporated into the shaft, however, this solution extends the length of the shaft thereby occupying additionally commercial space which could otherwise be utilized by the building owner for another purpose. An alternative solution is to create temporary refuge spaces.

U.S. Pat. No. 5,727,657 describes an elevator system wherein a temporary refuge space is created in the pit by pivoting a swivel buffer into the travel path of the car to prevent the car from entering into the pit. A temporary overhead refuge space can be established in a similar fashion by either pivoting a swivel buffer located in the pit into the travel path of the counterweight, or by pivoting a swivel buffer arranged at the shaft ceiling into the travel path of the car.

In order for a worker to be able to climb into the shaft pit, the car is sent to a higher floor. The landing door at the lowermost floor can be unlatched and opened by rotating a bolt within the door frame with a standard triangular key. Furthermore, the rotation of the triangular bolt moves a latching switch into the detent or set position whereby a safety chain is interrupted and normal operation of the elevator is prohibited. When the safety chain is thus interrupted, the swivel buffer, or preferably an opposed pair of the swivel buffers, tilts automatically into the travel path of the car and thus blocks the return of the car to the lowermost floor and accordingly a temporary refuge space is created in the pit. Just before, or immediately after the technician climbs into the shaft pit, he can actuate the control off pit switch, required by regulation, so that a multiple interruption of the safety chain is achieved. The maintenance and checking work to be undertaken can now be performed with reduced risk.

After completion of the work in the pit, the pit switch is released and the landing door is closed and latched. However, the elevator car still is not yet ready for normal operation because the latching switch of the memory circuit is still in the set position interrupting the safety chain. In order to reset the latching switch and thereby the safety chain which in turn retracts the swivel buffer to the non-active position, the technician must activate a key switch at the elevator control which is located outside the elevator shaft preferably in the machine room or located beside or within a door frame at the uppermost floor of the installation. Not only is this frustrating to the technician who has to mount the stairs from one extremity of the building to the other but it is time consuming and therefore costly to the building owner. Furthermore, during this procedure, there is a complete lack of supervision at the landing door where the latching switch is in the set position so feasibly a person, for example another technician, could open the landing door and enter the shaft, unknown to the technician. Upon activation remote activation of the key switch, the safety chain is re-established, the temporary refuge spaces are automatically removed and the elevator resumes normal operation placing the person in the shaft in an extremely dangerous situation.

An objective of the present invention is overcome the disadvantages associated with the prior art. This objective is achieved by providing a circuit for resetting a component within an elevator safety chain. The reset circuit comprises a first reset switch and a door contact. The first reset switch is mountable within an elevator shaft. The door contact is mountable alongside an elevator landing door. The first reset switch and the door contact are arranged in series so that both must be closed to reset the component whereby, upon activation, the first reset switch remains closed for a first predetermined time period after which it returns to its open state.

Accordingly, the invention permits the technician to reset the elevator safety chain directly from the landing by closing the landing door to activate the door contact. The imposition of a first predetermined time period within which the reset sequence must be completed firstly dramatically reduces the risk of inadvertently resetting of the safety chain and secondly forces the technician to make a conscious decision to reset the safety chain since any delay or interruption will extend the time taken beyond the first predetermined time period in which case the entire procedure will have to be repeated until such time as is completed within the first predetermined time period.

The first reset switch can be accessible from the landing when the landing door is open and is preferably mounted above the landing door. Thereby, the technician can activate the first reset switch by simply reaching through the open landing door and into the shaft to activate the first reset switch and according all stages of the reset sequence are initiated by the technician while standing outside of the shaft.

Preferably, the first reset switch is an interval delay relay.

The first predetermined time period can be set to be marginally greater than the time taken for the landing door to close automatically. Upon activation of the first reset switch, the technician need only withdraw his hand from the shaft and release the landing door from its fully open position. Such action should generally be completed within 2 s. Subsequently, the door will automatically move under bias to its closed position which, for example, may take 6 s. Accordingly, in this situation, the first predetermined time period should be set to 8 s. Naturally the first switch can be positioned such that the door need not be fully opened to activate the switch in which case the first predetermined time period can be reduced preferably to less than five seconds.

To improve security and longevity, the circuit can further comprise a second reset switch mountable external to the shaft and arranged in series with the first reset switch and the door contact. This necessarily increases the reset sequence and consequently the first predetermined time limit should be increased but should preferably be less than ten seconds. Preferably, the second reset switch remains closed for a second predetermined time period after which it returns to its open state and more preferably it is an interval delay relay. The second predetermined time period should be set to reflect the operating parameters of the component within the elevator safety chain. In particular, the second time must be sufficiently long to enable the reset of the elevator safety chain component, however should not be so excessive as to damage or burn out the component.

The invention also provides an elevator comprising a car vertically displaceable within a shaft, a plurality of landing doors and a safety chain. In use, if one of the landing doors is opened without the simultaneous presence of the car at that level, the safety chain is broken and the car is prevented from further travel. The elevator further comprises a reset circuit as described above to reset the safety chain. The first reset switch can be mounted to a door frame and preferably to either to an upper transverse section or a side portion of the door frame. In the preferred embodiment, the elevator safety chain component is a bi-stable safety switch which interrupts the safety chain when the landing door is opened without the simultaneous presence of the car at that level.

The present invention is hereinafter described by way of specific examples with reference to the accompanying drawings in which:

FIG. 6 is a schematic showing a reset circuit according to the preferred embodiment of the present invention;

FIG. 7*a* is a graphical representation of the operating conditions of the first interval delay relay of FIG. 6;

FIG. 7*b* is a graphical representation of the operating conditions of the door contact of FIG. 6;

FIG. 7*c* is a graphical representation of the operating conditions of the second interval delay relay of FIG. 6; and FIG. 7*d* is a graphical representation of the operating conditions of the elevator safety chain.

Figure 1:
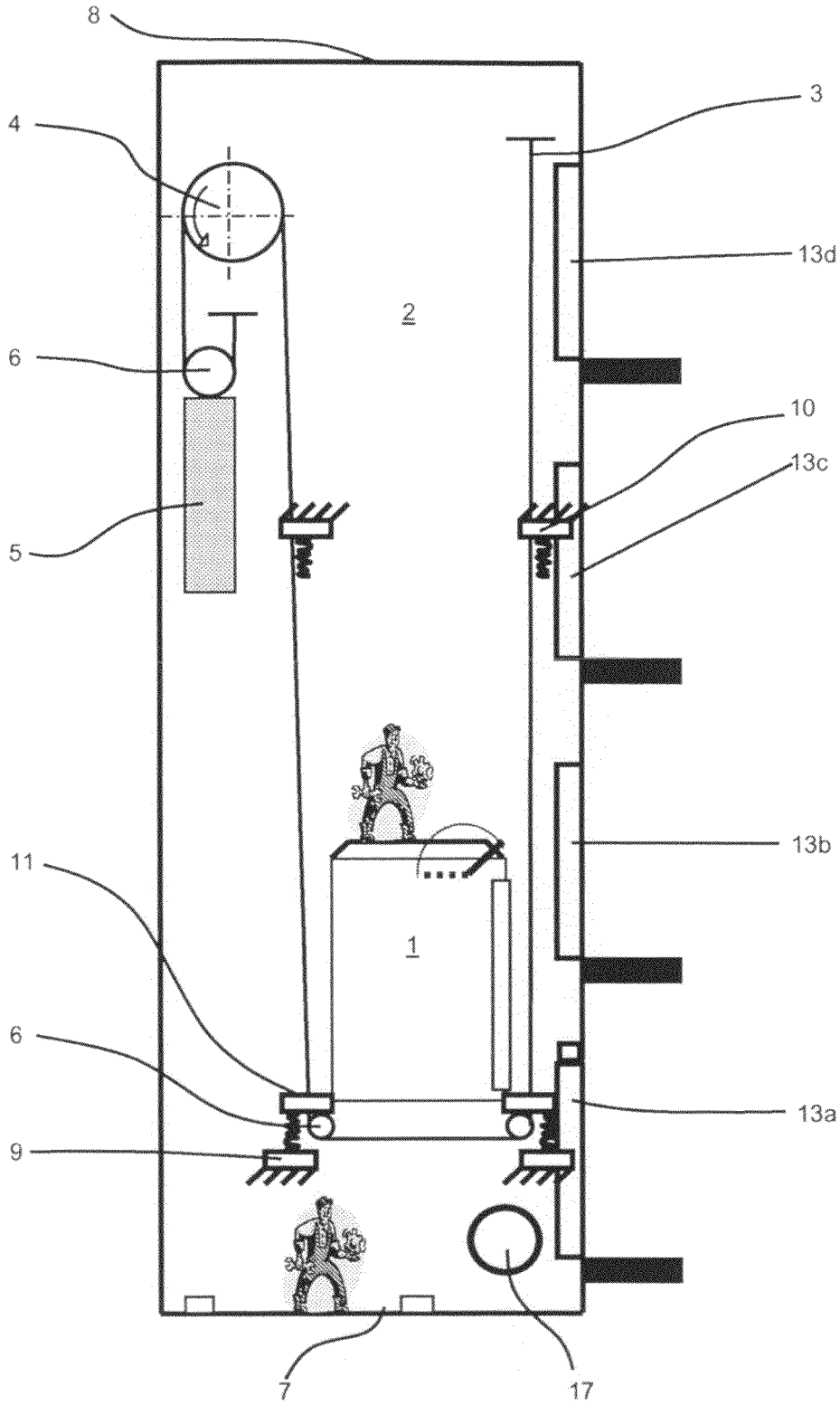
FIG. 1 is a general schematic of an elevator incorporating a reset circuit according to the present invention.

FIG. 1 shows an elevator arranged within a building. The elevator comprises a car 1 and a counterweight 5 which are supported on a load carrying element 3 by pulleys 6. The load carrying element 3 is fixed at either end and is driven by a traction sheave 4 to vertically displace the car 1 and the counterweight 5 in opposite directions along associated guide rails (not shown) mounted within a shaft 2. When the car 1 is level with any landing, passengers can enter or exit the car 1 through the respective landing door 13*a*, 13*b*, 13*c*, 13*d*.

When a service technician is required to enter the elevator shaft 2, for example to conduct periodic maintenance or inspection operations, bolts 11 are extended from the bottom of the car 1. As shown in specifically in FIG. 1, the car 1 is prevented from moving along its normal travel path into a pit 7 of the elevator shaft 2 through the engagement of the extended bolts 11 with a first set of buffers or brackets 9 secured to the guide rails or mounted to the shaft walls, thereby creating a temporary refuge space in the pit 7. Similarly, a temporary overhead refuge space is created between a shaft ceiling 8 and the roof of the car 1 through the engagement of the extended bolts 11 with a second set of buffers or brackets 10 mounted at a higher position within the shaft 2. Such arrangements are further described in EP-A1-1602615 and U.S. Pat. No. 7,258,202. After the required refuge spaces have been created, the service technician can safely enter the pit 7 through the lowermost landing door 13*a*.

Figure 2:
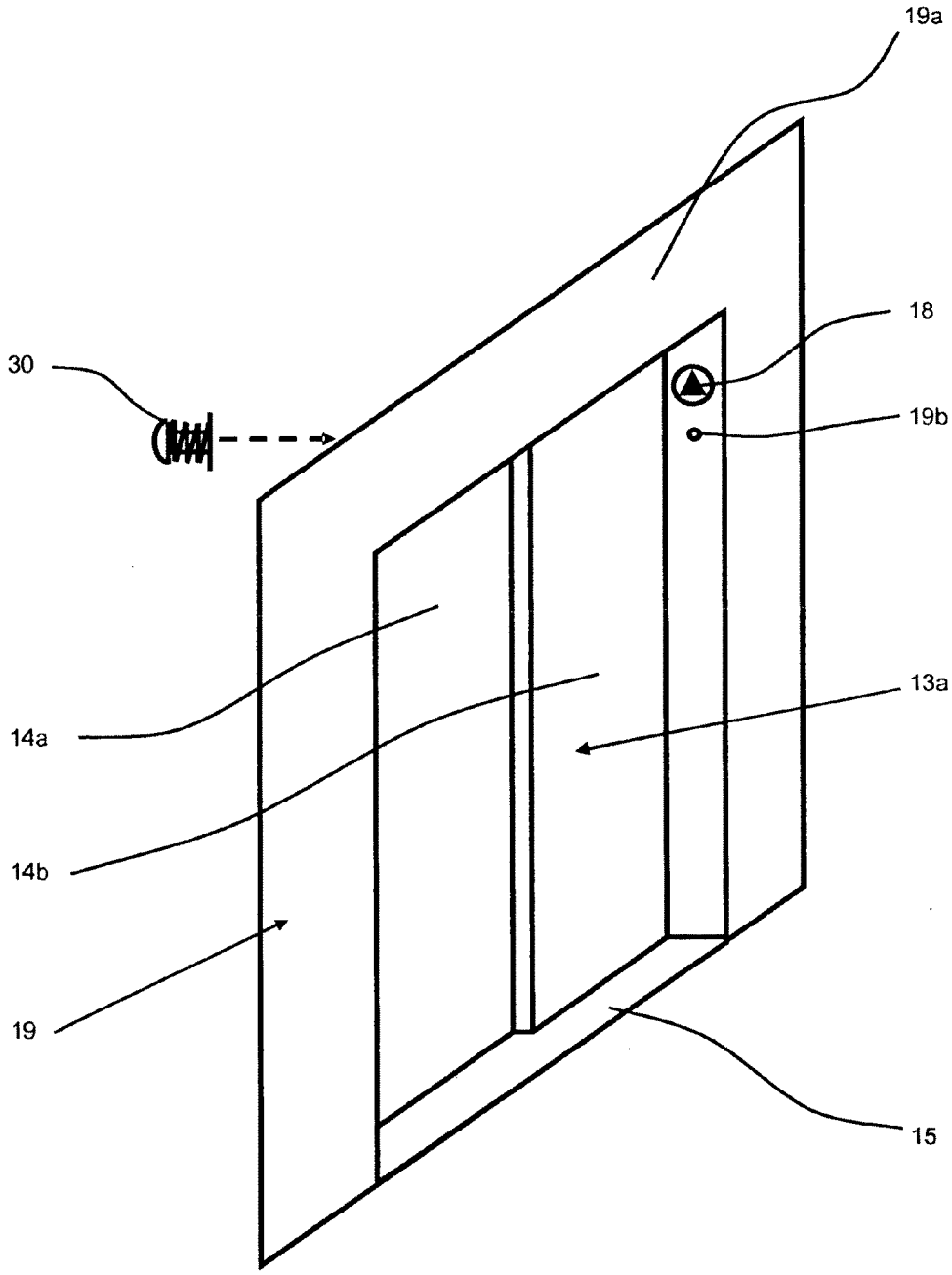
FIG. 2 is a perspective view of the landing door at the lowermost floor of FIG. 1 as viewed from the front or hall side thereof.

As shown in FIG. 2 the lowermost landing door 13*a* comprises a fast panel 14*a* and a slow panel 14*b* which telescope past each other to open and close the entrance to the shaft 2. The door 13*a* is bound at the bottom by a sill 15 and is surrounded by a door frame 19 consisting of two side portions and an upper transverse section 19*a*. A reset push button 30 is mounted inside the shaft 3 on the upper transverse section 19*a* of the door frame 19 and is accessible to a technician standing on the sill 15 through the open landing door 13*a*.

A triangular bolt 18 and a small hole 19*b* are provided in a side portion of the door frame 19 and are normally covered by screw lids (not shown) or a slide (not shown). In order to gain access to the pit 7, the service technician rotates the bolt 18 using a standardized triangular key. This action not only unlatches and permits the technician to manually open the door 13*a*, but simultaneously sets a memory circuit and interrupts an elevator safety chain 23, as illustrated in the FIGS. 3, 4 and 5. With the landing door 13*a* open, the technician can reach into the shaft 2 and actuate a pit switch 17, required by regulation in the pit 7, to ensure that a multiple interruption of the safety chain 23 is achieved. The maintenance and inspection work to be undertaken can now be performed with reduced risk.

Figure 3:
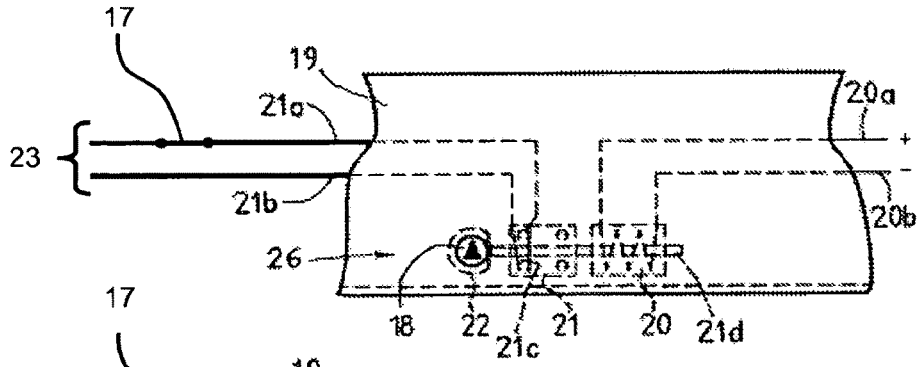
FIG. 3 is an enlarged fragmentary view of the unlatching and release device shown in the FIG. 2 before actuation.
Figure 4:
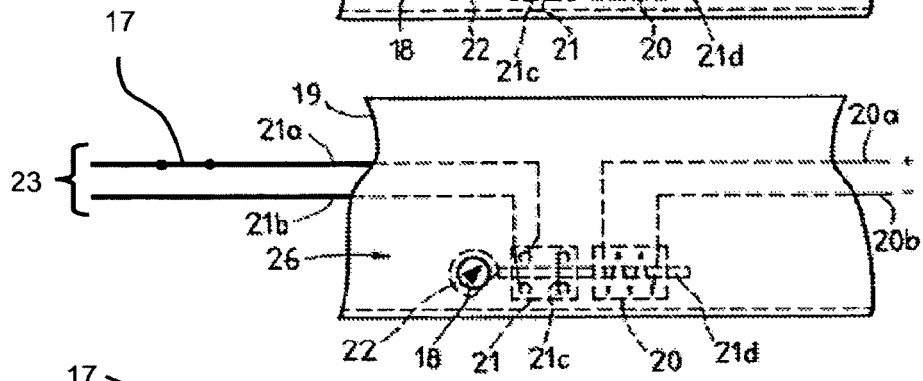
FIG. 4 is a view similar to FIG. 3 showing the unlatching and release device upon actuation.
Figure 5:
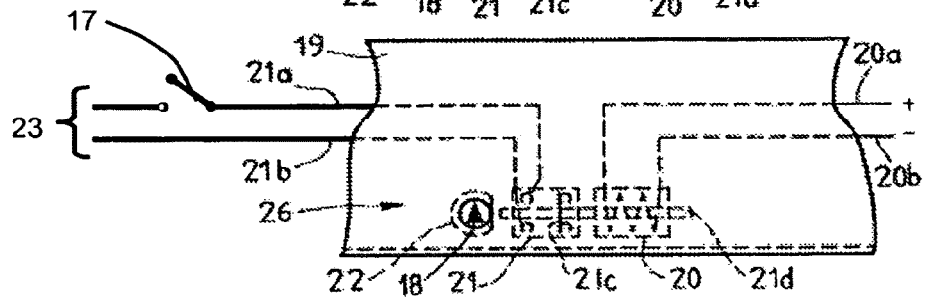
FIG. 5 is a view similar to the FIG. 4 showing the unlatching and release device after the actuation and before resetting.

The bolt 18 and the memory circuit are components of an unlatching and release device 26 as shown in FIGS. 3, 4 and 5. The memory circuit includes a bi-stable, safety switch 21 and a resetting element in the form of an electromagnet 20 which forces the safety switch 21 to an initial setting as shown in the FIG. 3. The switch 21 has a first pair of contacts connected to a pair of signal lines 21*a* and 21*b* which, in the initial setting, are bridged by a switch element 21*c*. The signal lines 21*a* and 21*b* and the safety switch 21 form a branch of the elevator safety chain 23.

The actuation of the memory circuit takes place by way of a switching cam 22 coupled to the triangular bolt 18. When the triangular bolt 18 is rotated through a predetermined angle, a switch actuator rod 21*d* of the safety switch 21 is moved by the rotated cam 22 into a detent setting or set position as shown in the FIG. 4 and remains in this setting after the release of the triangular bolt 18. The actuator rod 21*d* is coupled to the switch element 21*c* which is moved away from the first set of switch contacts, thereby interrupting the safety chain 23, to bridge a second set of switch contacts. Upon release, the bolt 18 is rotated by a spring force to the initial position as shown in the FIG. 5. However, the switch element 21*c* and the actuator rod 21*d* remain in the detent or set position. As discussed above, activation of the pit switch 17 further interrupts the elevator safety chain 23 as shown in FIG. 5.

Once the required work has been completed in the shaft 2, the technician can reset the pit switch 17 whereby the unlatching and release device 26 reverts back to the condition as shown in FIG. 4. However, in this condition the elevator is prevented from returning to normal service because the safety chain 23 is still interrupted by the bi-stable, safety switch 21 which remains at the detent setting or set position.

A circuit 34 for resetting the safety switch 21 is shown in FIG. 6. After resetting the pit switch 17, the technician, while standing on the sill 15, presses the reset push button 30 mounted inside the shaft 2 on the upper transverse section 19*a* of the door frame 19 through the open landing door 13*a*. This in turn activates a first interval delay relay 31 at time $t_0$ which remains closed for a first predetermined time period $\Delta t_1$ after which it returns to its open state as shown in FIG. 7*a* (wherein logic 1 represents the relay 31 in a closed condition and logic 0 represents the relay 31 in an open condition). The first time period $\Delta t_1$ strictly defines the timeframe in which all of the following actions must be taken in order to reset the safety switch 21.

Next, at time $t_1$, the technician closes the door 13*a* and a door contact 33 closes upon the reset circuit 34, as shown in FIG. 7*b*, confirming that the door 13*a* has been closed and locked.

Finally, at time $t_2$, the technician activates a second interval delay relay 32 by inserting a small screw driver 16 through the hole 19*b* in the landing door frame 19. The second interval delay relay 32 remains closed for a second predetermined time period $\Delta t_2$ as shown in FIG. 7*c*.

So long as the first interval delay relay 31, the door contact 33 and the second interval delay relay 32 are simultaneously closed onto the reset circuit 34 for the second time period $\Delta t_2$, sufficient energy is provided to the electromagnet 20 at time $t_3$ through power supply lines 20*a* and 20*b* to shift the switch element 21*c* and the actuator rod 21*d* to the left and back to the initial position shown in the FIG. 3. Accordingly, the pit switch 17 and the switch element 21*c* complete the safety chain and the elevator automatically returns to normal operation as represented in FIG. 7*d*. The second time period $\Delta t_2$ must be sufficiently long to enable the energized electromagnet 20 to reset the safety switch 21, however should not be so excessive as to damage or burn out the electromagnet 20. In the present embodiment the acceptable range is between 0.2 s and 0.5 s and the second time period $\Delta t_2$ is set to 0.3 s.

Although the invention has been described above specifically for arrangement at the lowermost landing door 13*a*, it will be appreciated that the invention can equally be applied to any landing door through which the service technician gains access to the shaft 2 in order to carry out his work. For example, to gain access to the roof of the car 1, a technician will generally call the car 1 to one of the upper floors. Upon arrival, he will enter the car 1, register a call for a lower floor and immediately leave the car 1. Once the landing door subsequently closes, the car 1 starts to descend and a short time thereafter the technician will unlatch the landing door by rotating an associated triangular bolt 18. As before, such action will simultaneously set a memory circuit, interrupt the elevator safety chain 23 and thereby stop the car 1. Upon manually opening the landing door, the roof of the car should be easily accessible. However, before mounting the roof, the technician must press a stop switch (equivalent to the pit switch 17) provided on the car roof to ensure multiple interruption of the safety chain 23. Thereafter, using a car mounted inspection control device, the technician can drive the car at inspection speed along the restricted travel path (defined by the first set buffers 9 and the second set of buffers 10 as shown in FIG. 1) to carry out the required maintenance and inspection operations from the top of the car 1. The triangular bolt 18, the memory circuit, the safety chain branch 23 and the resetting circuit 34 used for this upper landing door are identical to, and operate in exactly the same way, as those shown and described in relation to the lowermost landing door 13*a* with the sole exception that the car mounted stop switch replaces the pit switch 17.

In an alternative embodiment, the second switch 32 can be a conventional bi-stable switch without interval delay action.

Although the preferred embodiment requires a three stage sequence (activation of the first interval delay relay 31, closing door 13*a* to close the door contact 33 and activation of the second interval delay relay 32) to reset the safety switch 21 and thereby the safety chain 23, it will be appreciated that the invention can be simplified while maintaining many of its advantages by eliminating the second interval delay relay 32 and the related third stage of the resetting sequence.

The first predetermined time period $\Delta t_1$, established by activating the first interval delay relay 31, should be sufficiently short so that safety switch 21 and safety chain 23 will not be reset if there is even a slight delay or interruption to the reset sequence. In such a case, the sequence will need to be repeated until it is completed within the time period $\Delta t_1$. For the three stage reset sequence used in the preferred embodiment, the first predetermined time period $\Delta t_1$ should be less than 10 s. For the two stage sequence described in the paragraph immediately above, the first predetermined time period $\Delta t_1$ should be only marginally greater than the time it takes for the landing door to close and preferably less than 5 s.

In an alternative embodiment, the reset push button 30 can be mounted one of the side portions of the door frame 19 within the shaft 2 instead of on the upper transverse section 19*a*.

The invention claimed is:

1. A circuit for resetting a component within an elevator safety chain comprising:

a first reset switch mountable within an elevator shaft; and a door contact mountable alongside a landing door;

wherein the first reset switch and the door contact are arranged in series so that both must be closed to reset the component, and configured such that upon activation, the first reset switch remains closed for a first predetermined time period after which the first reset switch returns to an open state.

2. A circuit according to claim 1, wherein the first reset switch is accessible from a landing when the landing door is open.

3. A circuit according to claim 1, wherein the first reset switch is mountable above the landing door.

4. A circuit according to claim 1, wherein the first reset switch is an interval delay relay.

5. A circuit according to claim 1, wherein the first predetermined time period is greater than a time taken for the landing door to close automatically.

6. A circuit according to claim 1, wherein the first predetermined time period is less than five seconds.

7. A circuit according to claim 1 further comprising a second reset switch mountable external to the elevator shaft and arranged in series with the first reset switch and the door contact.

8. A circuit according to claim 1, wherein the first predetermined time period is less than ten seconds.

9. An elevator comprising:

a car vertically displaceable within a shaft, a plurality of landing doors;

a safety chain; and a reset circuit in accordance with claim 1, wherein, in response to opening one of the plurality of landing doors at a particular level while the car is not present at that level, the safety chain is broken and the car is prevented from further travel.

10. An elevator according to claim 9, wherein the first reset switch is mounted to a door frame.

* * * * *